US006431221B1

(12) United States Patent
Wrigley

(10) Patent No.: US 6,431,221 B1
(45) Date of Patent: Aug. 13, 2002

(54) FABRIC AND SEAM CONSTRUCTION

(75) Inventor: David Wrigley, Whitstable (GB)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/646,879

(22) PCT Filed: Apr. 9, 1999

(86) PCT No.: PCT/GB99/00930

§ 371 (c)(1),
(2), (4) Date: Dec. 16, 2000

(87) PCT Pub. No.: WO99/53125

PCT Pub. Date: Oct. 21, 1999

(30) Foreign Application Priority Data

Apr. 9, 1998 (GB) ..... 9807704

(51) Int. Cl.[7] ..... D03D 3/04; D21F 1/12; D21F 7/10; D06H 5/00

(52) U.S. Cl. ..... 139/383 AA

(58) Field of Search ..... 139/383 AA

(56) References Cited

U.S. PATENT DOCUMENTS 4,149,571 A 4/1979 Burroughs
4,395,308 A * 7/1983 Dawes et al. ..... 139/383 AA
5,465,764 A * 11/1995 Eschmann et al. .... 139/383 AA
5,503,196 A 4/1996 Josef et al.
5,713,398 A 2/1998 Josef
5,769,131 A 6/1998 Whitlock et al.
6,189,577 B1 * 2/2001 Lee ..... 139/383 AA

FOREIGN PATENT DOCUMENTS

| | | |
|---|---|---|
| CH | 282335 | 8/1952 |
| DE | 19710877 | 10/1997 |
| FR | 2286235 | 4/1976 |
| WO | 92/15743 | 9/1992 |

* cited by examiner

*Primary Examiner*—Andy Falik
(74) *Attorney, Agent, or Firm*—Caesar, Rivise, Bernstein, Cohen & Pokotilow, Ltd.

(57) ABSTRACT

A woven fabric comprises cross-machine direction weft yarns, and an array of interwoven warp yarns, the warp yarns being woven in the machine direction in alternating groups of relatively narrow yarns and relatively wide yarns. The narrow yarns are looped around a respective last weft yarn and backwoven, whilst the wider yarns are extended to form interdigitable loops for engagement of a pintle wire.

9 Claims, 1 Drawing Sheet

FABRIC AND SEAM CONSTRUCTION

FIELD OF THE INVENTION

This invention relates to a woven fabric structure, partially in the field of papermachine clothing and other industrial belting, and particularly to structures contributing to the formation of a jointing seam in such a fabric for joining ends of the fabric to form an endless belt.

BACKGROUND OF THE INVENTION

A common form of seam is achieved by extending selected longitudinal (machine direction) warp yarns of the fabric beyond the last transverse (cross direction) weft yarn, to form a loop, the end of which is back-woven into the fabric. The non-selected machine direction warp yarns are looped about the last cross direction weft yarn and the end back-woven into the fabric. Such a structure is described in GB-A-1488815, which discloses two patterns of weaving back the looped yarns, and cutting short of certain other MD yarns to provide space for the back woven loop ends.

Normally all the warp yarns have the same thickness or width, so that as a result when using only half the warp-yarns to form the loops, to afford space for interdigitation of the corresponding loops of the opposite end of the fabric, the tensile strength of the seam is relatively poor and there is a higher propensity in the seam region for marking of the paper sheet due to the greater open area in the seam region, as about 50% of the total width of the fabric is open space.

One approach to solving this problem is to use more than 50% of the warp yarns to form the loops. An example of this is WO 92/15743 wherein the problem of obtaining space for interdigitation of loops where more than 50% space is used by the loops of each side, is tackled by crossing adjacent loops over each other. However the use of more than 50% warp yarns, and the crossing of the looped yarns makes the already complicated, prolonged and expensive seaming process take even longer to carry out.

U.S. Pat. Nos. 5,503,196 and 5,769,131 describe a warp yarn system in a papermakers fabric comprising single wide tape-like yarns alternating with pairs of narrow yarns. The wide yarns are disposed with long floats and form an outer shell to protect the woven structure. These wide tape like yarns are, in U.S. Pat. No. 5,503,196 explicitly not used for seaming whilst U.S. Pat. No. 5,769,131 shows wide yarns from one fabric end being interdigitated with narrow yarns from the other fabric end, and the wide yarns are not used for seaming from both ends of the fabric.

SUMMARY OF THE INVENTION

An object of the invention is to provide a fabric structure which enables seaming to be carried with more than 50% of the warp yarn width, thus attaining lower open space in the seam, leading to a reduced propensity to marking of the paper sheet.

According to the invention a woven fabric structure comprises an array of warp yarns interwoven with an array of substantially orthogonally extending weft yarns using warp yarns of differing width, characterised in that said warp yarns comprise relatively wide warp yarns arranged in groups of two or more alternatively with relatively thin warp yarns arranged in groups of two or more and that said relatively wide warp yarns are extended in a seam region to provide seaming loops on each end of the fabric.

The fabric is preferably for papermachine clothing, such as a dryer fabric a forming fabric, extending nip press belt, press sleeve, basecloth, or for a filter belt or conveyor belt.

The warp yarns are preferably arranged in groups comprising alternating pairs of relatively wide yarns and pairs of relatively thin yarns. The alternating groups of warp yarns may each comprise single yarns, or any other number, and need not comprise the same of wider and thinner yarns in the respective groups.

In seaming the fabric, in order to effect a loop and pintle wire joining seam between the opposite ends of the fabric, the thinner yarns are preferably looped around the last weft yarn (extending parallel to the edge, across the width of the fabric), and the wider yarns are extended beyond the last weft yarn to form loops which are interdigitated with similar loops of the opposing fabric end, and joined by a pintle wire passed through the tunnel formed by the interdigitated loops.

The loops will, being provided by the wider yarns, comprise more than 50% of the width of the fabric.

The fabric may comprise a single layer woven construction, with all weft yarns in a single tier, however multi layer, or multi-weft tier fabrics may also be used.

The warp yarns, at least the wider yarns, are preferably flat yarns. The thinner yarns may also be flat yarns. However either or both the wider and thinner warp yarns may be of other cross-sectional profiles, such as triangular or semi-circular.

The invention also provides a method of seaming a woven fabric for forming the fabric into an endless belt the fabric being formed with an array of longitudinally extending warp yarns of differing widths, characterised in that the warp yarns comprise relatively wide yarns arranged in groups of two or more alternatively with relatively thin warp yarns arranged in groups of two or more, said relatively thin warp yarns being looped about a last weft yarn of the fabric edge, and the relatively wide warp yarns being formed into extended loops extending in the plane of the fabric beyond said last weft yarn at both ends of the fabric.

Preferably the seam is completed by interdigitating said loops with corresponding loops on an opposed end of the fabric, and passing a pintle or wire through said interdigitated loops.

The invention further provides an endless fabric formed by seaming by the method according to the invention, or comprising a fabric including a woven fabric structure according to the invention.

DESCRIPTION OF THE DRAWINGS

A preferred embodiment of fabric structure, seam, seaming method and endless fabric according to the invention will now be described by way of example with reference to the accompanying drawings wherein like referenced numerals refer to like parts and wherein:

In FIG. 1, a woven fabric for a papermachine or other belt comprises.

DETAILED DESCRIPTION OF THE PREFERRED EMBODIMENTS

The wider and thinner yarns may be grouped in numbers other than pairs, from single yarns up, and the groups of wider and thinner yarns may comprise different numbers of yarns, e.g. 1 and 2, or 2 and 3.

Figure 1:
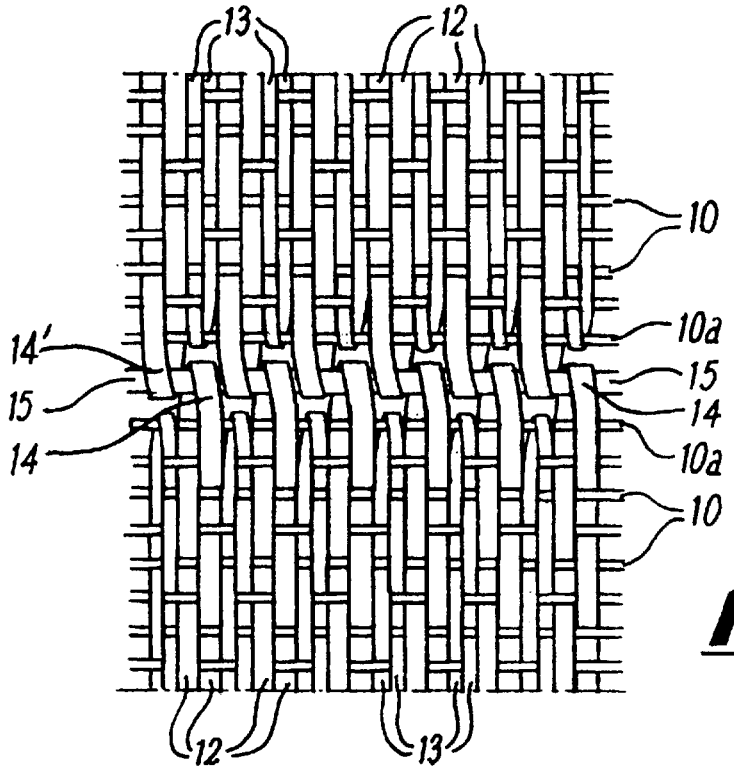
FIG. 1 is a fragmentary enlarged detail view of part of a seam edge region of a woven papermachine fabric, showing part of the weave structure of the fabric of the seam formation.

In an example similar to FIG. 1, a seam with 75% cover, ie 25% open area was made using flat warp (MD) yarns measuring 0.27×39 mm and 0.27(height)×0.75 mm(width). For every set of 4 warp yarns, two are wide, and are used to form seam loops 14. The seam strength was measured at 43 kg/cm, compared with 32 kg/cm for a fabric containing 56% warp cover if 4 narrow warp yarns are used in each set. These figures apply to a fabric with a warp density of 188 ends per 10 cm, woven to allow 6% reed width, and following heat setting has a warp density of 200 ends/10 cm.

Figure 2A:
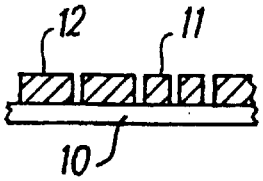
FIGS. 2*a* to 2*c* are cross-sectional views of yarn cross-sections used in the fabric.
Figure 2B:
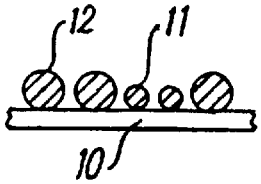
Figure 2C:
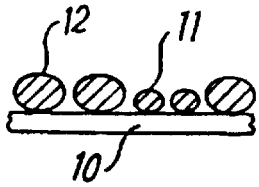
Figure 3:
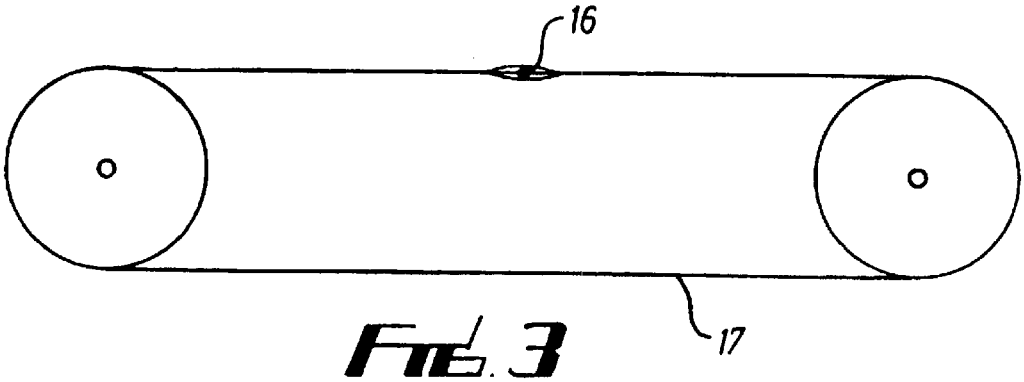
FIG. 3 is a diagram of an endless belt formed by the seamed fabric of the invention.

As shown in FIG. 2, the yarns, particularly the wider yarns 12 may have any of a number of cross-sectional profiles, such as flattened (FIG. 2*a*), circular (FIG. 2*b*) or elliptical (FIG. 2*c*).

The weave structure and seamed fabric belt of the invention can be in any appropriate application as papermachine clothing, as a filter belt, or conveyor belt or the like. The fabric may constitute a base for a further layer or layers such as fibrous non-woven batts etc, filtration coatings etc, depending upon the intended use of the belt.

The narrow yarns 11, may be of equal height to the yarns 12, as shown in FIG. 2*a* to form a mono-planar sheet support surface, or may be of the same proportions, and thus lower than the wide yarns as in FIGS. 2*b* and 2*c*. This latter arrangement is desirable when a ribbed dryer fabric is required, such ribs may be provided on the sheet side or the machine side of the fabric. The ribs and grooves in one end of the fabric are preferably aligned with these on the other end the fabric on the opposite side across the seam. Ribbed fabrics can also be used to emboss the sheet, for example as a tissue forming or drying fabric, or to provide yarns standing proud to provide extra resistance to wear.

The seam construction can be used to make an endless forming fabric or press felt, or base cloth.

What is claimed is:

1. A woven fabric structure comprising an array of machine direction yarns interwoven with an array of substantially orthogonally extending cross machine direction yarns using machine direction yarns of differing widths, said machine direction yarns comprising groups of relatively wide machine direction yarns and groups of relatively thin machine direction yarns, said groups of relatively wide machine direction yarns alternating with said groups of relatively thin machine direction yarns, said groups of relatively wide and of relatively thin machine direction yarns each including one or more wide or thin machine direction yarns respectively, wherein said relatively wide machine direction yarns are extended into a seam region to provide seaming loops on each end of the fabric structure.

2. The fabric structure according to claim 1 wherein at each end of the fabric the groups of relatively thin machine direction yarns are looped around the last cross machine direction yarn, and the groups of relatively wide machine direction yarns are extended beyond said last cross machine direction yarn to form loops, which can be interdigitated with similar loops of the opposing fabric end and joined by a pintle wire passed through a tunnel formed by the interdigitated loops.

3. The fabric structure according to claim 2 wherein the extended loops comprise more than 50% of the width of the fabric.

4. The fabric structure according to claim 1 wherein the relatively wide machine direction yarns are flat yarns.

5. The fabric according to claim 1 wherein either or both of the wider and thinner machine direction yarns are of a triangular or semicircular cross-section.

6. A method of seaming a woven fabric to form the fabric into an endless belt, comprising forming the fabric with an array of longitudinally extending machine direction yarns of differing widths by arranging relatively wide machine direction yarns in groups of one or more alternately with groups of one or more relatively thin machine direction yarns, looping said relatively thin machine direction yarns about a last cross direction yarn of the fabric edge, and extending the relatively wide machine direction yarns into a seam region to form extended seaming loops extending in the plane of the fabric beyond said last cross direction yarn at both ends of the woven fabric.

7. The method according to claim 6 further comprising completing the seam by interdigitating said loops with corresponding loops on the opposed end of the fabric and passing a pintle wire through said interdigitated loops.

8. An endless fabric formed by seaming a fabric having a structure comprising an array of machine direction yarns interwoven with an array of substantially orthogonally extending cross machine direction yarns using machine direction yarns of differing widths, said machine direction yarns comprising groups of relatively wide machine direction yarns and groups of relatively thin machine direction yarns, said groups of relatively wide machine direction yarns alternating with said groups of relatively thin machine direction yarns, said groups of relatively wide and of relatively thin machine direction yarns each including one or more wide or thin machine direction yarns respectively, wherein said relatively wide machine direction yarns are extended into a seam region to provide seaming loops on each end of the fabric structure.

9. The endless belt formed by the method of claim 6.

* * * * *